US006327884B1

(12) United States Patent
Wills

(10) Patent No.: US 6,327,884 B1
(45) Date of Patent: Dec. 11, 2001

(54) PRESS BRAKE TOOLING WITH HARDENED SURFACES

(75) Inventor: George F. Wills, White Bear Lake, MN (US)

(73) Assignee: Wilson Tool International, Inc., White Bear Lake, MN (US)

( * ) Notice: Subject to any disclaimer, the term of this patent is extended or adjusted under 35 U.S.C. 154(b) by 0 days.

(21) Appl. No.: 09/672,698

(22) Filed: Sep. 29, 2000

(51) Int. Cl.[7] ..... B21D 5/02
(52) U.S. Cl. ..... 72/46; 72/379.2; 72/389.3
(58) Field of Search ..... 72/379.2, 389.3, 72/46, 47

(56) References Cited

U.S. PATENT DOCUMENTS

| | | | | |
|---|---|---|---|---|
| 3,240,914 | | 3/1966 | Hill et al. . | |
| 4,158,578 | | 6/1979 | Komatsu et al. . | |
| 4,268,323 | | 5/1981 | Jakubowski et al. . | |
| 4,446,351 | | 5/1984 | Kawaguchi et al. . | |
| 4,738,730 | | 4/1988 | Ferguson . | |
| 4,765,847 | | 8/1988 | Arai et al. . | |
| 4,790,888 | | 12/1988 | Bessey . | |
| 4,862,728 | * | 9/1989 | Hardouin | 72/467 |
| 4,936,911 | | 6/1990 | Roberts et al. . | |
| 5,093,151 | * | 3/1992 | Van Den Berg et al. | 427/249 |
| 5,234,721 | | 8/1993 | Rostoker et al. . | |
| 5,244,375 | | 9/1993 | Laurence et al. . | |
| 5,306,531 | | 4/1994 | Laurence et al. . | |
| 5,306,568 | | 4/1994 | Matsuda et al. . | |
| 5,396,788 | | 3/1995 | Dziedzic et al. . | |
| 5,887,475 | * | 3/1999 | Muldner | 72/379.2 |
| 5,921,131 | * | 7/1999 | Stange | 72/379.2 |
| 6,053,722 | | 4/2000 | Topolski et al. . | |

OTHER PUBLICATIONS

Davis et al., ASM Handbook, vol. 4, Heat Treating, pp–410–424 (1991).
Brochure of Kolene Corporation, Colene SBN, Proven Technology for Enhancing Performance (1998).
Weymuller, Gas Nitriding Increases Wear Resistance and Fatigue Strength, Metal Progress, Jul. 1972, pp. 187–188.
Jones, Precise Gaseous Ferritic Nitrocarbeurizing Treatment, Industrial Heating, Mar. 1988.
Brochure of Lindberg Heat Treating Co., Using the Lindure Process to Meet your Material Improvement Needs, believed to be available at least one year prior to the filing of the instant application.
Newsletter of Lindberg Heat Treating Company, Hot Lines, Significant Developments in Thermal Processing and Surface Coatings, Col. 1, Issue 2, Fall 1991.

* cited by examiner

*Primary Examiner*—David Jones
(74) *Attorney, Agent, or Firm*—Fredrikson & Byron, P.A.

(57) ABSTRACT

Press brake tooling comprising a die and mating punch for bending sheet stock, the punch having an elongated, generally V-shaped punch tip and the die being of steel and having an elongated, generally V-shaped groove within which said punch tip is received during a bending operation. The V-shaped groove of the die has a floor and sidewalls that extend from the floor and terminate in edges that are spaced from each other across the width of the groove. The edges have surfaces that are configured to slidingly encounter the surface of a workpiece as it is bent between the tool and die. At least the die edge surfaces are nitrided or nitrocarburized to provide a slippery surface over which the workpiece slides during a bending operation, the edge surfaces having a hardness in the range of 52–70 Rockwell C with such hardness extending to a depth not exceeding about 0.06 inches.

5 Claims, 2 Drawing Sheets

PRESS BRAKE TOOLING WITH HARDENED SURFACES

FIELD OF THE INVENTION

The present invention relates to press brake tooling, and particularly to press brake dies having workpiece contacting surfaces that are nitrided or nitrocarburized to a depth of not greater than 0.06 inches.

BACKGROUND OF THE INVENTION

Press brake tooling comprises a punch having an elongated edge which is generally "V" shaped in cross section, and a die having an elongated groove which has a complementary V-shaped cross sectional configuration. The upwardly open V-shaped groove of the die terminates upwardly in a pair of spaced edges. When a work piece—a piece of sheet metal, for example, is to be bent in the press brake, it is placed between the punch and the die, and the punch , which is vertically aligned with the die, presses downwardly upon the work piece. As the work piece bends, its bottom edges slide across the spaced edge surfaces of the groove. As this occurs, the edge surfaces of the groove may become scratched, chipped or otherwise worn away. The V-shaped punch, on the other hand, has a downwardly facing edge that contacts the upper surface of the workpiece primarily at a single line of contact, and comparatively little sliding motion between the workpiece and the punch edge occurs.

Depending upon the character of the surface of the work piece, and its stiffness (that is, its resistance to bending), the sliding motion between the bottom surface of the work piece and the surfaces of the spaced edges of the die can cause substantial damage to the spaced edges of the die. Once scratches, pits or wear appear in the die, the rate of wear of the die accelerates, and when the die surface is damaged to the point that the workpiece is affected, of course, the die must be replaced.

For reasons of economy, it is important that a die be capable of being used many times before the die needs to be replaced. To this end, die surfaces have been hardened so as to resist scratching, pitting or wear. The hardening of these surfaces, due to the methods of hardening, has been continued deep into the surfaces.

Two basic methods have been used to harden the surfaces of press brake dies. One of these methods involves making the entire die out of a tempered steel piece, but the resulting die is susceptible to breakage during use. The second method involves a heat hardening method, such as flame hardening or induction hardening, in which the surfaces of the die are hardened generally down to a depth of ⅛" or more in order to achieve the desired surface hardness. This is a somewhat long and expensive process and produces only fair results.

As mentioned above, the hardening processes commonly used continue the hardening process well into the thickness of the die from its surface. Accordingly, die hardening methods involving only surface hardening, for example, have not been thought adequate.

It would be desirable to provide a die having a edge surfaces that are so resistant to abrasion as to be capable of repeated use without significant scratching, pitting or wear, thus reducing the necessity of purchasing expensive tooling and reducing downtime as dies are replaced.

BRIEF SUMMARY OF THE INVENTION

We have found, that, contrary to popular opinion, the surfaces of the die which are subjected to a rubbing or sliding action by the work piece can be nitrided or nitrocarburized to a small depth, generally not greater than about 0.06 inches, and that the resulting tool is highly resistant to scratching, pitting or wear. This surprising result appears to be due not only to the superior hardness that is provided by the nitriding and nitrocarburizing processes, but particularly to the slipperiness that these processes provide. Although we do not wish to be bound to the following explanation, it appears that the smooth, lubricious surface of the spaced die edge surfaces enable work pieces to slide more easily across these surfaces in a bending operation. As a result of their hardness and lubricity, the surfaces accordingly are highly resistant to scratching, pitting or wear or other deformation, and provide dies having a long life. The frequency of repair or replacement of dies can thereby be significantly reduced.

Thus, the present invention provides press brake tooling comprising a die and a mating punch for bending sheet stock, the punch having an elongated, generally V-shaped punch tip and the die being of steel and having an elongated, generally V-shaped groove in which the punch tip is received during a bending operation. The groove in the die has a floor and side walls extending divergently from the floor and terminating in edges spaced from each other across the width of the groove. The edges have edge surfaces that are configured to slidingly encounter the surface of a work piece as it is bent between the tool and the die. The die edge surfaces are nitrided or nitrocarburized to have a hardness in the range of 52–70 Rockwell C (that is, 86 to 94 on a 15-N microhardness scale), with said hardness extending into the die to a depth not exceeding about 0.06 inches.

At least the edge surfaces of the die are thus nitrided or nitrocarburized, and desirably nitriding or nitrocarburizing is performed, if not on the entire die, at least that portion of the die including the spaced edge surfaces and the floor and walls of the V-shaped groove. As noted, the nitriding and nitrocarburizing processes provide a hardness of 52–70 Rockwell C (86–94 on a 15-N microhardness scale to a depth not exceeding about 0.06 inches and preferably not greater than about 0.03 inches.

DESCRIPTION OF THE PREFERRED EMBODIMENT

Nitriding and nitrocarburizing processes are known in the field and need not be described with great detail. Reference is made to U.S. Pat. Nos. 4,790,888 and 4,268,323, the latter patent referring to the use of a fused salt bath to enable nitrogen and carbon to diffuse into the surface of a steel piece suspended in the bath, to form a carbonitride case.

Reference is made also to U.S. Pat. No. 5,234,721 (referring to methods of forming carbonitride coatings).

Nitriding processes, both plasma (ion) nitriding and liquid nitriding, are described in detail in the ASM Handbook prepared under the direction of the ASM International Handbook Committee, Revised vol. 4: *Heat Treating*, pp. 410–424 (1994), the disclosures of which are incorporated by reference herein. Plasma or ion nitriding involves the use of glow discharge technology to provide nascent nitrogen to the surface of a heated steel part. Here, the part is subjected to a nitrogen plasma in a vacuum chamber. Nascent nitrogen diffuses into the surface of the part to form an outer "compound" zone containing $\gamma(Fe_4N)$ and $\epsilon(Fe_{2,3}N)$ intermetallics, and an inner "diffusion" zone which may be described as the original core microstructure with some solid solution and precipitation strengthening. Liquid nitriding involves immersing a steel part in a molten, nitrogen-containing fused salt bath containing cyanides or cyanates, e.g., NaCN or NaCNO.

To utilize any of these processes, a steel or tempered steel press brake die is formed having smooth, spaced upper edge surfaces on either side of its groove, and either the edge surfaces of the die to be contacted by a workpiece, or these surfaces together with the upwardly divergent walls forming the V-shaped grove, or even larger portions or all of the tool, can be subjected to a selected nitriding or nitrocarburizing process. What is important here is that the spaced edge surfaces of the tool that encounter in a sliding fashion the work piece during a bending operation be subjected to the nitriding or nitrocarburizing process.

Figure 1:
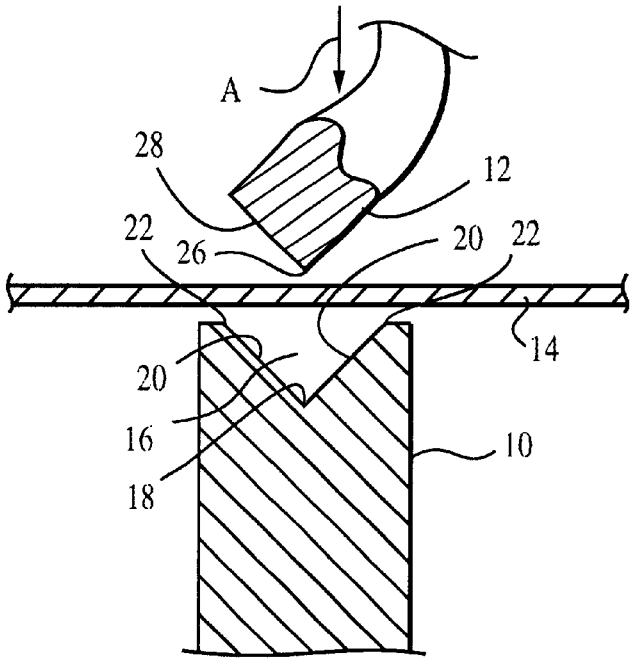
FIG. 1 is a broken-away, cross-sectional, largely schematic representation of a press brake punch and die of the invention, vertically aligned with a work piece between them, at the beginning of a bending operation.
Figure 2:
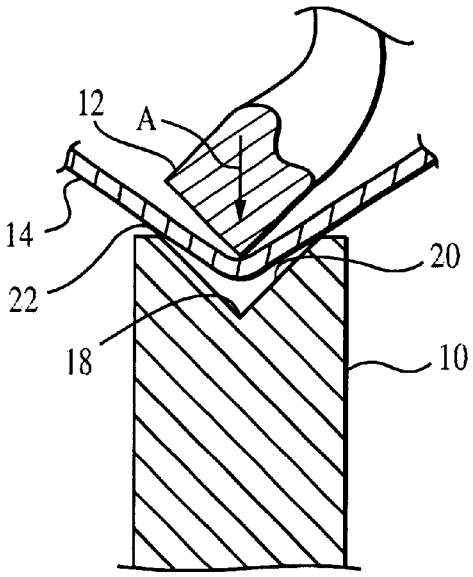
FIG. 2 is a broken-away, cross-sectional, schematic representation similar to that of FIG. 1, but showing the punch, die and work pieces at a point in the bending operation in which the work piece has been substantially bent.
Figure 3:
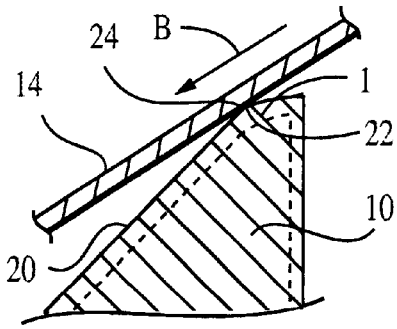
FIG. 3 is a broken-away, cross-sectional, schematic view showing a portion of an edge surface of a die as it is contacted by the lower surface of a workpiece during a bending operation.

With reference to FIGS. 1–3 a die of the invention is shown generally as 10, a complimentary shaped punch is shown as 12, and a work piece as 14. The die has an upwardly open groove, 16, having a floor 18, and upwardly diverging walls, 20, as depicted, terminating in spaced die edges 22. The floor 18 may be the intersection of the upwardly divergent walls 20, or may be slightly rounded or slightly flattened, both for the purpose of avoiding stress concentration. As shown in FIG. 3, the edge 22 has a generally rounded edge surface 24 over which the work piece 14 slides during a bending operation. In a typical die of the invention, the groove 16 formed by the walls 20 may have an included angle ranging from 30 to 120 degrees, with each of the groove walls 20 being oriented at from 15 to 60 degrees to the vertical. Dies having included angles of about 90 degrees are common. The upper tool 12 is provided with a similar V-shape, as shown in FIGS. 1 and 2.

Arrow A in FIGS. 1 and 2 designate the direction of travel of the tool with respect to the die during a bending operation. If the included angle between the walls 20 of the die groove is assumed to be 90 degrees with each wall oriented to the vertical at a 45 degree angle, then simple mathematics shows that as the work piece is depressed completely into the groove by a distance (measured vertically) of one unit of length, it slides against the edge surface 24 over a length of about 0.4 units of length. The majority of the sliding action of the work piece across the edge surface 24 occurs after the work piece has reached the halfway mark in its vertical descent toward the floor 18 of the groove. The area of the edge surface contacted in a sliding, abrasive fashion by the work piece extends from about the upper curved upper edge 22 of the die, whereas the flat surfaces of the die require somewhat less in the way of resistance to scratching, pitting or wear or the like.

Thus, in accordance with the present invention, that portion of the die which must be provided with a nitrided or nitrocarburized surface is the gently curved area of the die edge surface which is slidingly encountered by the work piece during a bending operation.

Although, speaking broadly, only the edge surfaces of the die over which a work piece slides during a bending operation need be nitrided or nitrocarburized and hence rendered slippery and hard, as described herein, nitriding and nitrocarburizing processes common in the industry lend themselves to the hardening of larger surfaces, In this respect, it is appropriate to nitride or nitrocarburize the entire outer surface of the die, or at least the upper portion of the die that includes the V-shaped groove. Similarly, it may be appropriate to nitride or nitrocarburize the V-shaped punch that is received within the die, particularly the tip of the punch that initially encounters the work piece. Here, again, nitriding and nitrocarburizing processes may lend themselves most readily to harden either the entire punch, or at least that lower portion of the punch that includes the tip (26 in FIG. 1) together with the upwardly divergent walls 28 that form the V-shaped configuration of the punch tip.

Because of the resistance to scratching, pitting or wear due to the hardness of the rounded edge portion 24 of the die, and its lubricity, the hardness of the die need not extend deeply into its surface. The nitriding and nitrocarburizing processes provide a surface having a hardness in the range of 52–70 Rockwell C (86 to 94 on a 15-N microhardness scale). and this hardness extends into the surface to a depth not greater than 0.06 inches, and preferably not greater than about 0.03 inches. This is in sharp contrast to temperature-induced hardening of steel, in which the hardness extends to a depth of ⅛" or more. Nitrided and nitrocarburized die surfaces of the invention are substantially slipperier than the surfaces of identical dies that have not been so treated. For example, nitrocarburized surfaces have coefficients of friction on the order of about two-thirds of the coefficients exhibited by untreated surfaces, or less. Whereas a temperature-hardened steel surface may exhibit a coefficient of friction of about 0.4, a nitrocarburized surface may exhibit a coefficient of about 0.08.

Over an extended testing period, the dies of the invention have shown superior resistance to damage when repeatedly bending a variety of workpiece materials. Various tests were run in which a nitrocarburized die of the invention was tested against a commercially available case hardened die. Here, the dies were subjected to repeated bending cycles using the same workpiece materials, and the dies were periodically inspected for wear.

| | Commercial Die | Nitrocarburized Die |
|---|---|---|
| Test 1: | Wear appeared after 50 bends | No wear after 2500 bends |
| Test 2: | Heavy wear after 300 bends | No wear after 4500 bends |
| Test 3: | Wear appeared after 100 bends | No wear after 1800 bends |

Figure 4:
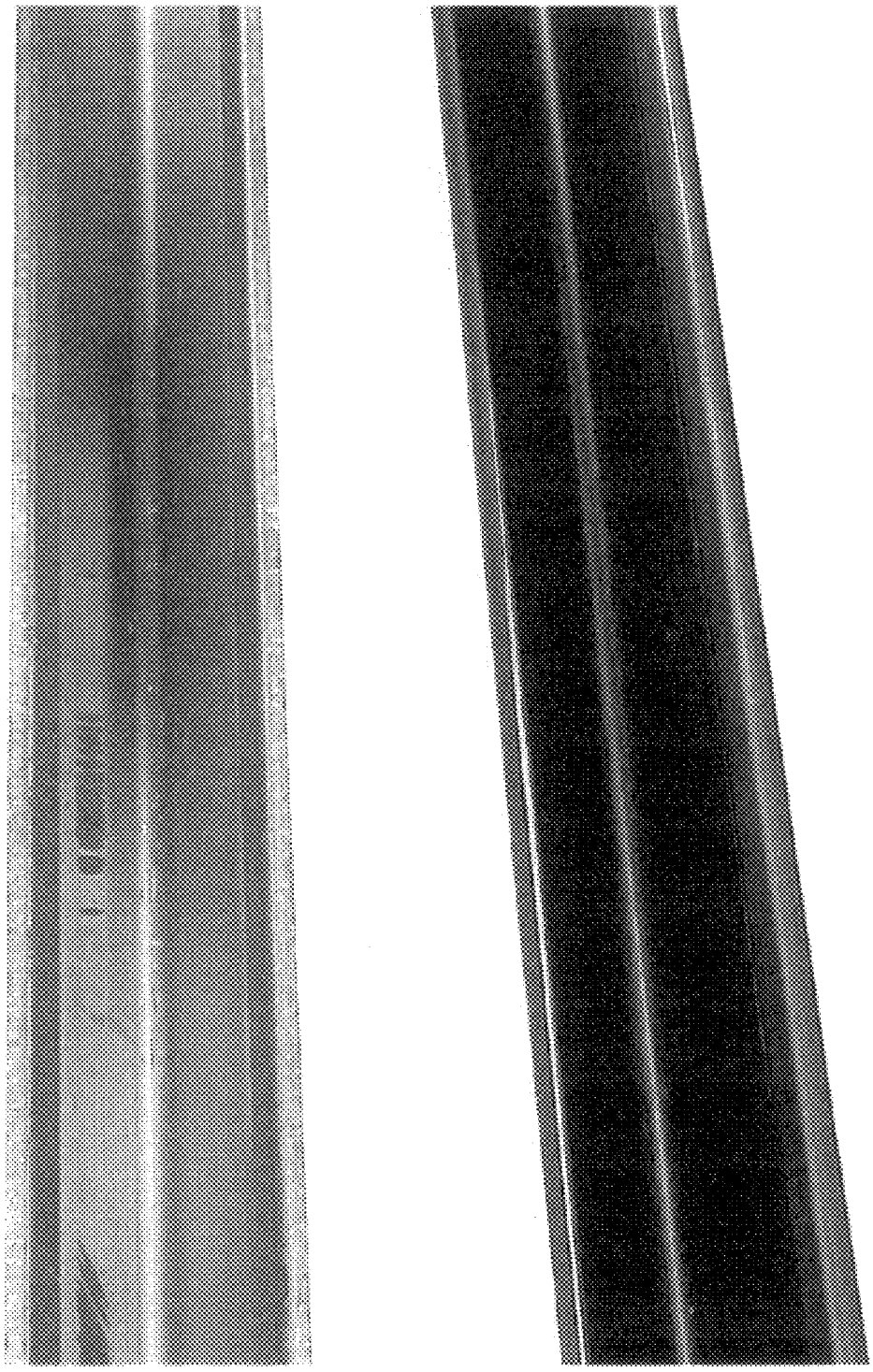
FIG. 4 is a photographic representation comparing the surface characteristics of a die of the invention with a commercially available die.

FIG. 4 shows the surface characteristics of two dies produced by Wilson Tool International, Inc., that were tested as above. The die on the left was heat hardened, and exhibits a substantial amount of scratching and wear, especially on the edges over which the workpiece slides. Dies that are damaged this badly are commonly replaced. The die on the right has a nitrocarburized surface that shows essentially no wear after undergoing approximately five times the number of bending cycles to which the die on the left was subjected.

While a preferred embodiment of the present invention has been described, it should be understood that various changes, adaptations and modifications may be made therein without departing from the spirit of the invention and the scope of the appended claims.

What is claimed is:

1. Press brake tooling comprising a die and mating punch for bending sheet stock, said punch having an elongated, generally V-shaped punch tip and said die being of steel and having an elongated, generally V-shaped groove within which said punch tip is received during a bending operation, said groove having a floor and sidewalls extending from the floor and terminating in edges spaced from each other across the width of the groove, said edges having edge surfaces configured to slidingly encounter the surface of a workpiece as it is bent between the tool and die, at least said die edge surfaces being nitrided or nitrocarburized to provide a slippery surface over which a work piece may slide, said surfaces having a hardness in the range of 52–70 Rockwell C with said hardness extending to a depth not exceeding about 0.06 inches.

2. The press brake tooling of claim 1 wherein said die edge surfaces have smoothly curved portions over which a work piece slides as it is bent, the smoothly curved portion being nitrided or nitrocarburized.

3. The press brake tooling of claim 2 wherein said smoothly curved surfaces of the die edges together with the floor and side walls of the groove are nitrided or nitrocarburized.

4. The press brake tooling of claim 3 wherein said punch tip that encounters a work piece is nitrided or nitrocarburized.

5. The press brake tooling of any one of claims 1–4 in which said hardness of the nitrided or nitrocarburized surface extends to a depth of not more than 0.03 inches.

* * * * *